US008092560B2

(12) United States Patent
Inaba et al.

(10) Patent No.: US 8,092,560 B2
(45) Date of Patent: Jan. 10, 2012

(54) LAPPING TOOL AND METHOD FOR MANUFACTURING THE SAME

(75) Inventors: Hiroshi Inaba, Yokohama (JP); Hiromu Chiba, Yokohama (JP); Xudong Yang, Yokohama (JP); Shinji Sasaki, Yokohama (JP); Nobuto Yasui, Yokohama (JP)

(73) Assignee: Hitachi, Ltd., Tokyo (JP)

( * ) Notice: Subject to any disclaimer, the term of this patent is extended or adjusted under 35 U.S.C. 154(b) by 1100 days.

(21) Appl. No.: 11/594,080

(22) Filed: Nov. 8, 2006

(65) Prior Publication Data

US 2007/0122548 A1 May 31, 2007

(30) Foreign Application Priority Data

Nov. 9, 2005 (JP) ..... 2005-324523
Sep. 25, 2006 (JP) ..... 2006-258237

(51) Int. Cl.

| | |
|---|---|
| ***B24B 1/00*** | (2006.01) |
| ***B24D 11/00*** | (2006.01) |
| ***B05D 1/12*** | (2006.01) |
| ***H05H 1/24*** | (2006.01) |
| ***C23C 14/00*** | (2006.01) |
| ***C23C 14/32*** | (2006.01) |
| ***C25B 11/00*** | (2006.01) |

(52) U.S. Cl. ..... 51/295; 51/293; 427/180; 427/569; 204/192.1; 204/192.32; 204/298.01

(58) Field of Classification Search ..... 51/293, 51/295; 427/180, 457, 523, 569; 204/19.1, 204/192.32, 192.1, 298.01, 298; 250/423 R; 219/121.36

See application file for complete search history.

(56) References Cited

U.S. PATENT DOCUMENTS 3,410,774 A * 11/1968 Barson et al. ..... 204/192.32

(Continued)

FOREIGN PATENT DOCUMENTS

| | | |
|---|---|---|
| JP | 07-132456 | 5/1995 |
| JP | 10-296620 | 11/1998 |
| JP | 2001-105326 | 4/2001 |
| JP | 2002-331452 | 11/2002 |

(Continued)

OTHER PUBLICATIONS

Morita, Analytical Calculation of Energy Spectra of keV Light Particles Reflected from Solid Surfaces, Japanese Journal of Applied Physics, vol. 22, No. 7, Jul. 1983, pp. 1112-1118.

*Primary Examiner* — Anthony Green
*Assistant Examiner* — Pegah Parvini
(74) *Attorney, Agent, or Firm* — Antonelli,Terry, Stout & Kraus, LLP.

(57) ABSTRACT

Since structural portions of a device made of a plurality of materials are different from one another in mechanical hardness, it is very difficult to uniformly lap the structural portions. This is attributable to generation of machining recessions due to differences in lapped amount when large fixed abrasive grains are used, and generation of lapping marks caused by that the dropped abrasive grains rotate. Accordingly, in order to cope with the disadvantage, it is essential to surely grip abrasive grains of small size to a surface of a surface plate.

[Solving Means]Abrasive grains are fixedly forced into a surface of a lapping tool with mechanical pressure and then the surface of the lapping tool including the abrasive grains is subjected to plasma processing, whereby an improvement in adhesion between the abrasive grains and a surface plate and reduction in the number of loose abrasive grains, which are dropped from the surface of the lapping tool, can be achieved, so that it is possible to realize lapping, in which a surface of a device made of a plurality of materials is made very plane.

6 Claims, 17 Drawing Sheets

U.S. PATENT DOCUMENTS

| | | | | |
|---|---|---|---|---|
| 4,908,046 | A * | 3/1990 | Wiand | 51/293 |
| 4,931,069 | A * | 6/1990 | Wiand | 51/293 |
| 5,707,409 | A * | 1/1998 | Martin et al. | 51/295 |
| 6,368,198 | B1 * | 4/2002 | Sung et al. | 451/443 |
| 2005/0241239 | A1 * | 11/2005 | Sung | 51/308 |

FOREIGN PATENT DOCUMENTS

| | | |
|---|---|---|
| JP | 2003-326453 | 11/2003 |
| JP | 2004-087056 | 3/2004 |
| JP | 2005-028470 | 2/2005 |
| JP | 2006-224235 | 8/2006 |

* cited by examiner

CORRELATION BETWEEN CUTTING EDGE DIAMETER AND CUTTING EDGE DENSITY

LAPPING TOOL AND METHOD FOR MANUFACTURING THE SAME

INCORPORATION BY REFERENCE

The present application claims priority from Japanese Application JP2005-324523 filed on Nov. 9, 2005 and Japanese Application JP2006-258237 filed on Sep. 25, 2006, the content of which is hereby incorporated by reference into this application.

BACKGROUND OF THE INVENTION

The present invention relates to a lapping tool used for lapping of a surface of a substrate of a magnetic head used in hard disk drive, an optical connector ferrule used in optical fiber connection, etc., which is made of different materials, and a method of manufacturing the same.

An improvement in areal recording density is desired in hard disk drives, and in order to attain this, a flying height of a magnetic head relative to a magnetic recording medium is needed to be further decreased from about 10 nm at present. In order to realize a decrease in flying height, it is essential that a slider surface (air bearing surface) of a magnetic head arranged in opposition to a rotating magnetic recording medium be subjected to very smooth surface finishing with further high accuracy.

Generally, magnetic heads are fabricated in the following manner. That is, $Al_2O_3$ (alumina, film thickness of 2 to 10 μm) as an insulation film is formed on a hard substrate made of $Al_2O_3$—TiC (alumina titanium carbide), etc., a magnetic device part composed of a shield layer, a gap film, a magnetoresistive film, etc., a lower magnetic pole, an upper magnetic pole, an overcoat (alumina layer) are successively laminated thereon. The structure described above is formed on a 5-inch size substrate by means of thin film processing, in which lithography is used.

Thereafter, a diamond wheel is used to cut the substrate into reed-shaped pieces having a length of 2 inches. After strain after cutting is removed by the use of a method such as both face lapping, etc., a surface perpendicular to the structure laminated on the substrate is subjected to lapping with high accuracy to form a slider surface (air bearing surface) of a magnetic head opposed to a magnetic recording medium, and small pieces including individual magnetic device parts are cut out from the reed-shaped piece to complete a magnetic head.

Generally, in a method of lapping such reed-shaped piece, a reed-shaped piece 14 bonded to a lapping jig is depressed against and slid on a lapping tool 12, which is made of a soft metal to grip abrasive grains (fixed abrasive grains) composed of diamond grains and rotates as shown in FIG. 1, while a hydrocarbon lubricating liquid 13 is dripped on the lapping tool, whereby working, in which a depth of cut is actually small, is performed, and thus working is performed to obtain a smooth surface.

FIG. 2 shows a lapping tool 12 and abrasive grains (fixed abrasive grains) 11 composed of diamond grains and fixedly forced into by mechanical pressures, and a height of an abrasive grain (fixed abrasive grain) 11 projecting from a surface of the lapping tool 12 is called cutting edge height 21.

Lapping conditions include the case where a lapping jig with a reed-shaped piece bonded thereto is rotated and revolved relative to a rotating lapping tool, the case where a reed-shaped piece is oscillated in a direction perpendicular to a rotational direction of a lapping tool, or in parallel to the rotational direction, or the like, details of which are described in JP-A-7-132456.

SUMMARY OF THE INVENTION

However, electronic or optical devices including magnetic heads and optical connector ferrules are made of a so-called composite material including a plurality of materials. With magnetic heads, a member, which constitutes a reed-shaped piece described above, that is, a substrate, an insulation film, a magnetic device part, an overcoat, etc. respectively, are different in mechanical hardness, so that it is very difficult to use the technique described above to perform uniform lapping. Specifically, in the case where dissimilar metals are different in mechanical hardness, depth of lapping is varied and steps (machining recession) are generated by lapping when fixed abrasive grains are large. Also, loose abrasive grains, which are generated when the fixed abrasive grains fall out of the substrate, generate flaw of lapping (lapping mark).

Such lapping mark and machining recessions (damage) are generated by reason that fixed abrasive grains 11 held on the lapping tool 12 shown in FIG. 2 fall to become loose abrasive grains. Also, in order to obtain a further smooth lapped surface, further small abrasive grains are used but when fixed abrasive grains are made small in grain size, a force, with which abrasive grains are gripped on a surface plate, is rapidly decreased as shown in FIG. 3, so that fixation is made difficult, drop is generated to increase loose abrasive grains, and scratch is frequently generated.

In using such conventional technique, in case of performing finest surface working, an average fixed abrasive grain size (diameter of cutting edge) of about 125 nm and a cutting edge average height of about 50 nm constitute specifications of a lapping tool, which provides substantial limits, in terms of a gripping force on a lapping tool, lapping efficiency, and surface hardness of a processed surface.

It is an object of the invention to provide a lapping method, in which a lapped part is decreased in surface roughness and damage due to working is small, in a method of manufacturing general electronic or optical devices including magnetic heads and optical connector ferrules, which are made of the composite material described above. A further object is to enable an improvement of electronic equipment, in which parts composed of the electronic or optical devices are mounted, in performance.

Lapping mark and machining recessions (damage) are such that loose abrasive grains generated upon drop of fixed abrasive grains 11 held by a lapping tool as shown in FIG. 1 cause flaw of lapping (lapping mark). Also, in order to obtain a further smooth lapped surface, further small abrasive grains are used but when abrasive grains are made small, fixation of fixed abrasive grains 11 to a surface plate 12 is made difficult, loose abrasive grains are increased, and scratch is frequently generated.

Such problem is caused since fixed abrasive grains 11 are only mechanically held on a surface of the surface plate 12, which is made of a soft metal, by means of plastic deformation of the metal. Here, tin (Sn) is generally used for the surface plate 12, which is made of a soft metal having a high elastic deformation rate (low in Young's modulus). Sn has the Young's modulus of 41.4 GPa to be susceptible to elastic deformation. The reason why Sn is used includes "bendability" for irregularities of a work surface, which makes use of characteristics of such elastic deformation at the time of lapping working. That is, it is thought that a surface smoothing processing is made possible to be conformed to respective surfaces of irregularities of a work surface when a predetermined push load is applied to a work surface.

Representing this state in terms of plastic factor $\phi$, which indicates a degree of deformation of a contact point, the following formula (1) results $$\phi=(E/H)(\sigma/\beta)^{1/2} \quad (1)$$

where E indicates Young's modulus, H indicates hardness, $\sigma$ indicates surface roughness, and $\beta$ indicates a tip end radius of a projection.

Here, when E/H is large, plastic deformation is liable to generate. Accordingly, a state, in which fixed abrasive grains 11 made of hard diamond are embedded into the surface plate 12, which is made of a soft metal, corresponds to a state, in which E is small and H is large, that is, a state, in which E/H is small and plastic deformation is hard to generate. This state is excellent in terms of "bendability".

Accordingly, an ideal surface plate to obtain a further smooth lapped surface necessitates the use of diamond abrasive grains, which do not fall from a surface plate and are further fine, on a Sn surface plate, which is excellent in "bendability", in order to achieve less damage to a work.

In order to realize a lapping tool having diamond abrasive grains, which are further fine and do not make drop abrasive grains, the invention realizes an improvement in adhesion between fixed abrasive grains and a surface plate by fixedly forcing abrasive grains into a surface of the lapping tool with mechanical pressure and then subjecting the lapping tool to plasma processing in a vacuum chamber, use of further fine abrasive grains, and reduction of loose abrasive grains in a method of manufacturing a lapping tool.

Specifically, in case of using a lapping tool, in which diamond abrasive grains embedded into a surface of the lapping tool is 100 nm or less in average diameter, under predetermined conditions of lapping, an abrasive grain drop rate is around 40% in a conventional type lapping tool having not been subjected to plasma processing, while an abrasive grain drop rate can be made less than 5% by means of optimization of conditions of plasma processing when a lapping tool of the invention is used. Lapping efficiency is improved together with reduction in grain drop rate and a work as obtained can be made further small in surface roughness together with reduction in abrasive grain size. Here, the grain drop rate means a ratio, in which diamond abrasive grains beforehand embedded into a surface plate fall, and drop abrasive grains become loose abrasive grains.

For this effect, it has been clarified by evaluation of hardness of an uppermost surface of a surface plate that a surface of the surface plate is hardened by ion irradiation on thhe surface plate from plasma. It is thought that the reason for this is lattice strain caused by penetration of Argon ions.

Also, when a suitable accelerating voltage is given to perform plasma irradiation, a surface of a lapping tool is subjected to etching by Argon ions. At this time, what is exposed to the surface of the lapping tool comprises diamond abrasive grains as embedded by mechanical means and a base material of the plate.

The two members are different from each other in efficiency of etching with Argon ions and in particular, a tin alloy being a base material of the plate is much etched at a bias potential of the surface plate of −100 V to −300 V. Accordingly, diamond abrasive grains project by differences in etching amount from the surface plate surface. When a work is lapped by the use of such surface plate, abrasive grains acting on the work are increased in number to lead to an improvement in lapping efficiency. In particular, an increase in lapping load makes such effect conspicuous because those abrasive grains, which are blocked by a base material of the plate to be unable to contact with the work, can also contribute to lapping.

BRIEF DESCRIPTION OF THE DRAWING

These and other features, objects and advantages of the present invention will become more apparent from the following description when taken in conjunction with the accompanying drawings wherein.

DETAILED DESCRIPTION OF THE PREFERRED EMBODIMENTS

Embodiments of the invention will be described in detail with reference to the drawings.

Figure 1:
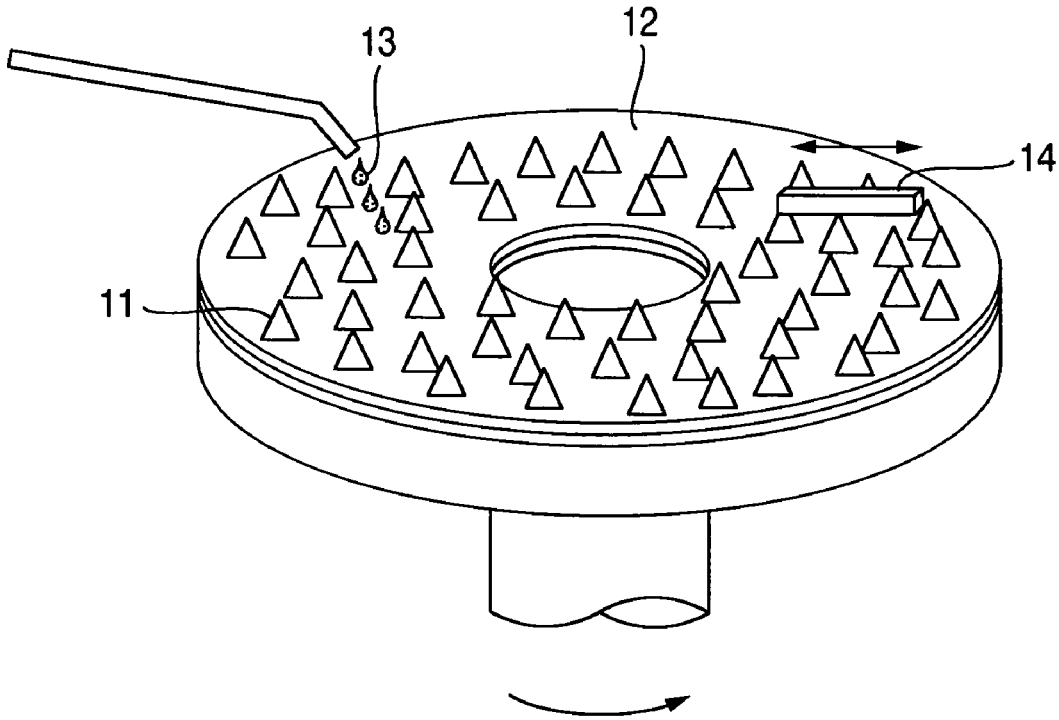
FIG. 1 is a view illustrating a lapping method.
Figure 2:
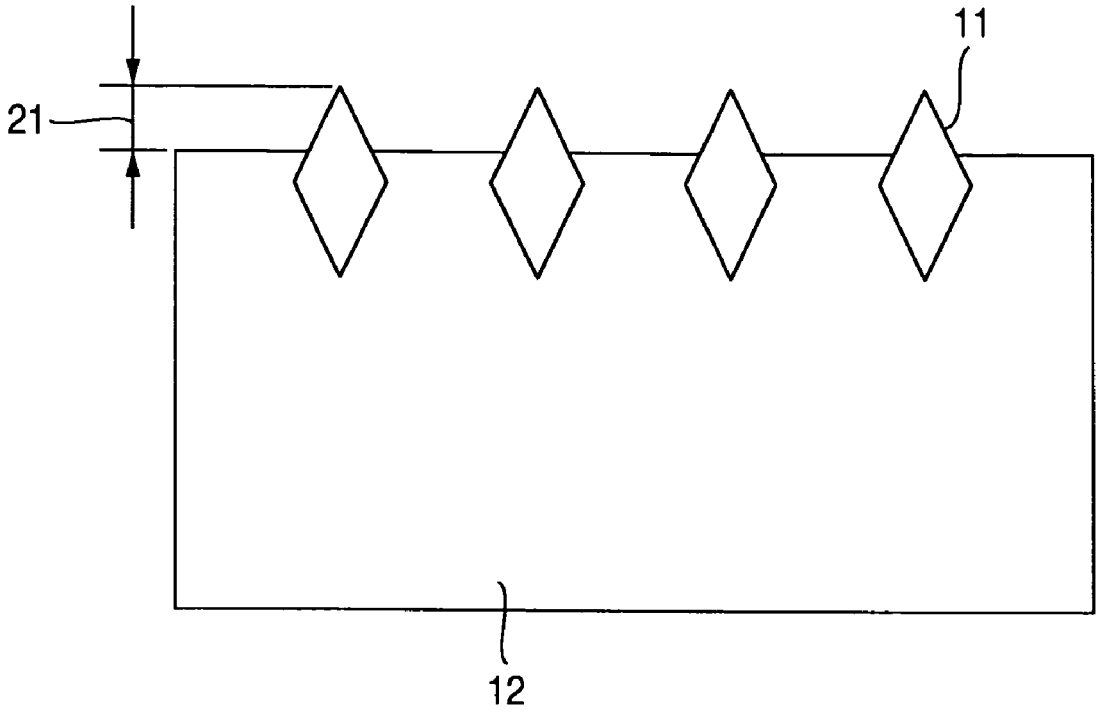
FIG. 2 is a view showing a section of a conventional lapping tool.
Figure 3:
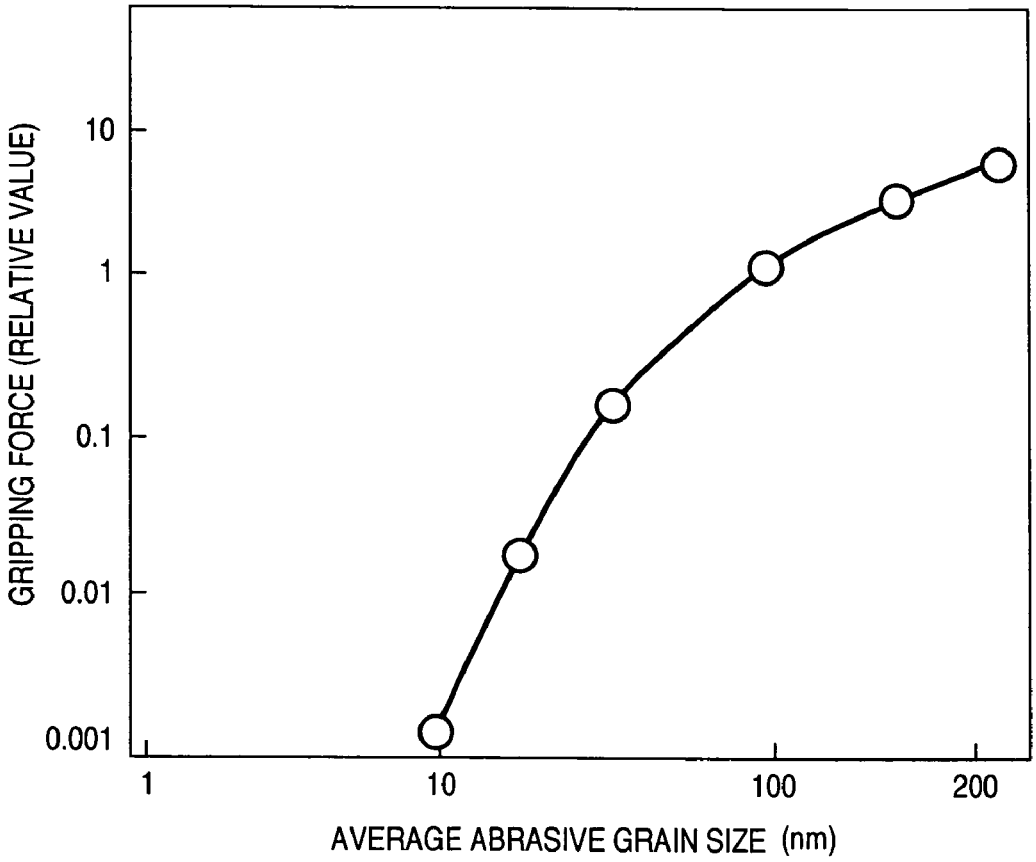
FIG. 3 is a view illustrating the relationship between an abrasive grain size and an abrasive grain gripping force in a conventional lapping tool.
Figure 4:
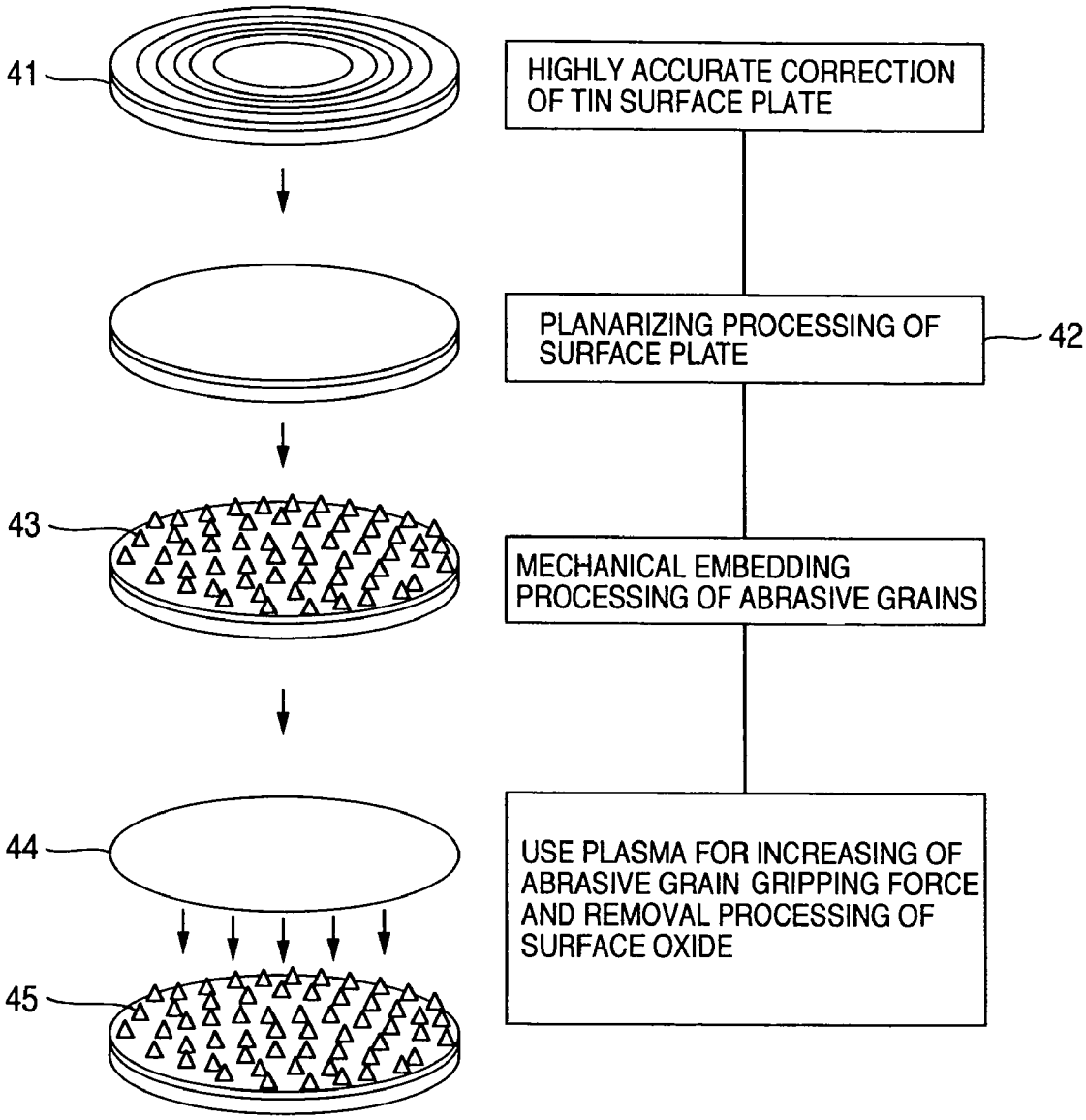
FIG. 4 is a schematic view illustrating forming processes of a lapping tool according to the invention, the tool being subjected to plasma processing.

FIG. 4 is a flowchart of a method of forming a lapping tool. Specifically, a tin soft surface plate 41 having a 15 inch size (about 380 mm) was prepared and a diamond bite was used to cut a surface (referred below to as tin surface) of a tin material to perform shape correction. For a diamond bite used in correction, one having a tip end diameter of 4 mmR was used and roughness of the tin surface was made 100 nm Rmax or less. Further, in order to planarize the roughness of the whole tin surface, a lapping cloth (Supreme) manufactured by Rodel-Nitta Ltd. and a lapping slurry having alumina grains of 50 nm in average abrasive grain size dispersed in an oil were used to perform a planarization 42 to provide for an average surface roughness of 10 nm Ra, and then a washing treatment was performed.

Subsequently, the surface plate surface 41 was subjected to a treatment, in which diamond grains 43 of about 80 nm in average abrasive grain size were mechanically embedded therein. Diamond fixed abrasive grains as embedded was 10 to 40 number/$\mu m^2$ in density and heights of diamond abrasive grains (projections as cutting edges) were positioned in substantially the same plane and ranged in 40 nm or less. This is because it is desired in the embedding technique that the height of cutting edges be equal to or less than 40%, preferably in the range of 5-30%, of a size of fixed abrasive grains.

By the way, a fundamental principle, on which a planarized, lapped surface is obtained, is to arrange cutting edges having a uniform height in high density to distribute a grinding load to the respective cutting edges to make cut minute. Accordingly, in the invention, a detailed examination was performed in fixed abrasive grains, which are about 100 nm or less in average abrasive grain size (diameter of cutting edge) and difficult in a lapping tool of the prior art.

Figure 6:
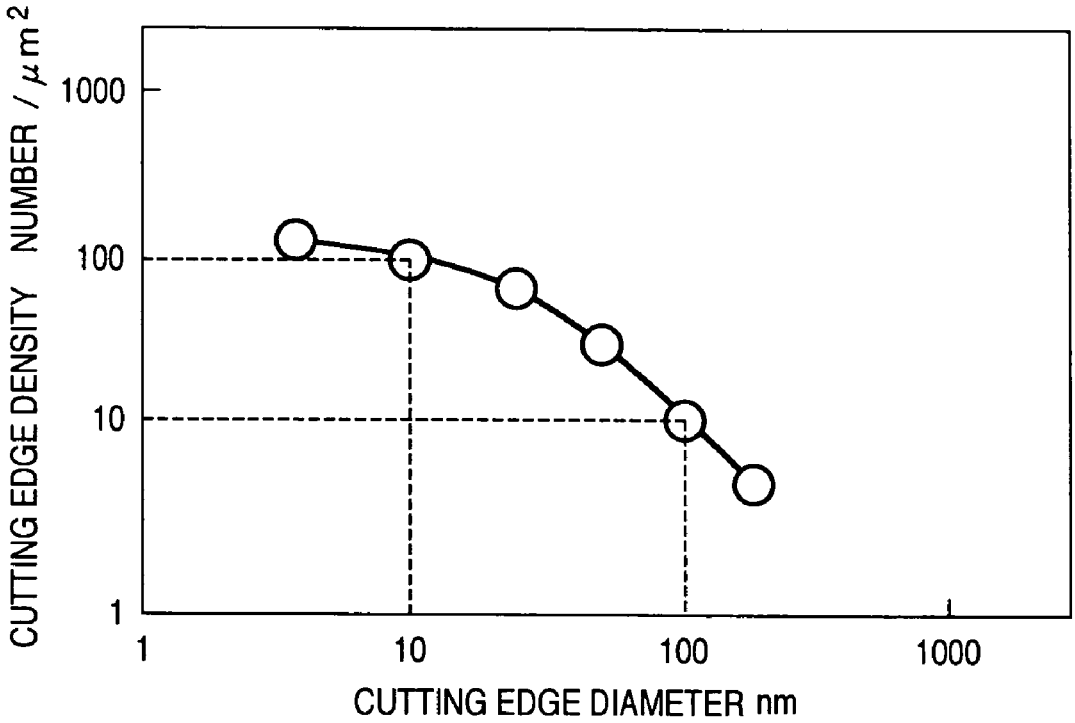
FIG. 6 is a view illustrating a section of a lapping tool according to the invention, to which plasma processing is applied.

FIG. 6 shows the correlation between a fixed abrasive grain size (diameter of cutting edge) and the density of abrasive grains and it was confirmed that when an abrasive grain size d was made minute, abrasive grains were increased in density and that by making a size of fixed abrasive grains minute, the correlation could be controlled in the range of 10 to 100 nm in abrasive grain size and 10 to 100 number/$\mu m^2$ in abrasive grain density. A cutting edge height at this time amounted to 4 to 40 nm in order to become equal to or less than 40%, preferably in the range of 5-30%, of a size of fixed abrasive grains.

Subsequent to the mechanical abrasive grain embedding process in FIG. 4, the tin soft surface plate 41 with diamond abrasive grains mechanically embedded therein is subjected to plasma process 44 in a vacuum chamber whereby a lapping tool (plasma-processed lapping tool) 45 of the invention is obtained, in which adherence of diamond abrasive grains 43 and the abrasive surface plate 41 is improved and which is subjected to removal process of an oxide on a lapping tool surface including abrasive grain surfaces as a quadratic effect.

An example of the plasma processing 44 will be described. The vacuum chamber was once evacuated to 1E-04 (pa) or less, and then argon gases were introduced thereinto at a flow rate of 100 sccm to put a process gas pressure at 20 mTorr. The lapping tool mounted in a chamber vessel was regarded as a cathode electrode to be connected to a high frequency power source via a matching box. Accordingly, the chamber vessel was made an anode electrode.

Subsequently, high-frequency power of about 200 W was applied to the lapping tool so that a bias potential of a surface plate of about −100 V was applied to a surface of a surface plate. At this time, the bias potential of the surface plate generated on the surface of the lapping tool caused argon positive ions (Ar+) in the plasma to penetrate the surface of the lapping tool. In particular, owing to lattice vibration, diamond grains having a high thermal conductivity gave thermal energy, which was given by ions, directly to an interface (mechanically embedded interface) of the diamond grains and the tin surface to provide for chemical bond of the interface, thus achieving an increase in adhesion. In addition, contents of conditions of the plasma process should be optimized according to a size, shape, etc. of the lapping tool and are not limited to the above.

Figure 5:
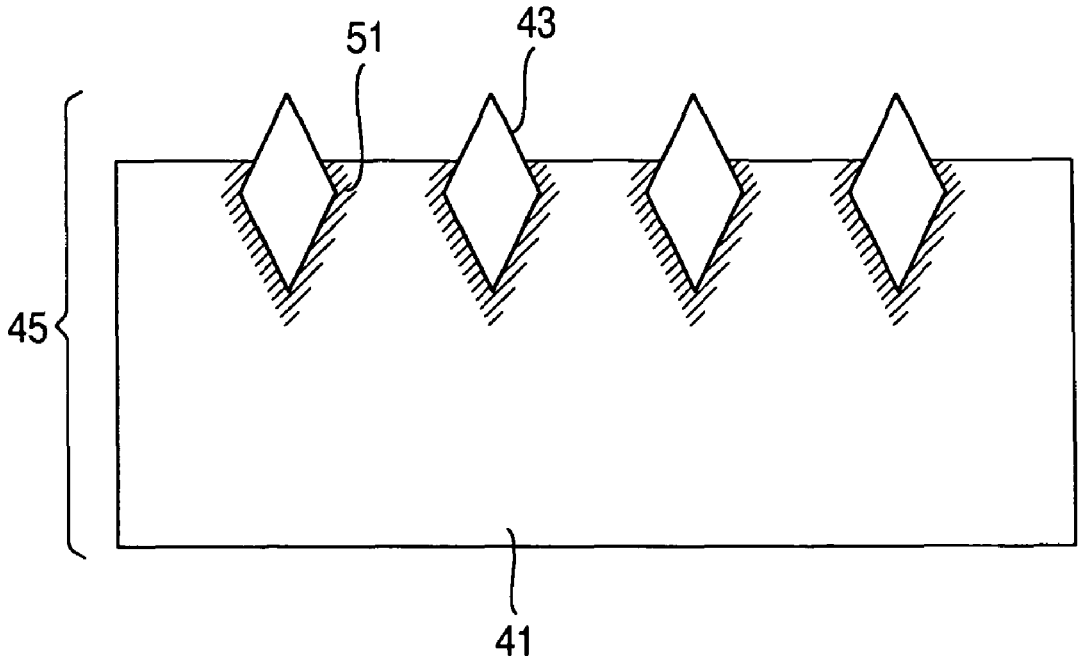
FIG. 5 is a correlation diagram illustrating the relationship between an abrasive grain size and an abrasive grain density in the invention.

FIG. 5 is a sketch drawing showing how diamond abrasive grains 43 mechanically embedded into a lapping tool are subjected to plasma processing to lead to an increase in gripping force of an interface of the diamond abrasive grains 43 and the tin soft surface plate 41.

Further, an effect of removal of an oxide on a lapping tool surface including abrasive grain surfaces is included as a quadratic effect of the plasma process. Specifically, argon ions are caused by the bias potential of the surface plate of about −100 V to penetrate about 1 nm into a surface of a tin surface plate to exhibit an etching effect. However, an oxide film on the surface of the lapping tool is in the order of about 3 nm and argon ions penetrate further to conversely break a tin surface structure, thus having an adverse effect on a property as a soft surface plate.

The relationship between energy of incident ions and a penetration depth into a substrate to be processed is described in detail in general literatures, for example, Japan Journal of Applied Physics, Vol. 22, No. 7, pages 1112-1118 (1983).

Stated briefly below, calculation can be made by using a model, in which ions incident upon a substrate to be processed give energy to atoms, which constitute a solid (substrate), in the course of deceleration. That is, assuming that a shielding Coulomb potential in the course of deceleration is a Thomas-Fermi potential, a stopping power (average energy given to a carbon thin film by incident ions) and a penetration depth of ions, which are incident upon a solid (substrate), are as follows:

$$dE/dx=N\sigma_n=(4\pi aNZ_1Z_2C_0e^2)(M_1(M_1+M_2))s(\epsilon)(J/m) \quad (2)$$

where $\sigma_n$: nuclear collision cross sectional area, $a=0.885a_0/(Z_1^{1/2}+Z_2^{1/2})^{2/3}$: Thomas-Fermi radius, $C_0=1/(4\pi\epsilon_0)$, $S(\epsilon)=d\epsilon/d\gamma$: dimensionless stopping power ($\epsilon$ conversion energy), $N=N_a\rho/M$, $M_1$, $M_2$: masses of atomic product density incident particle and target particle, and $Z_1$, $Z_2$: atomic numbers of incident grains and target grains.

In using the formula (2), when argon ions are incident upon a tin surface having a mass density of about 6.0 g·cm$^{-3}$ at 700 eV in energy, they penetrate about 3 nm into the tin surface. Accordingly, a process condition having an oxide removal effect, which has no harmful effect and does not break a tin surface structure, is to accelerate argon ions at self-bias in the range of 0 to −700 V. In this case, argon ions penetrate around 0.1 nm into diamond abrasive grains at 100 eV and around 0.4 nm at 700 eV, and so an etching effect comparable to that on a tin surface plate is not expected.

Also, melt-down of a lapping tool itself caused by plasma radiation heating should be cared for with respect to a general plasma process. Tin, which makes a lapping tool, has a melting point of about 230° C. and heating of a lapping tool at higher temperatures than the melting point must be avoided. Accordingly, it is necessary to pay attention to a plasma source and a chamber structure used in a plasma process apparatus for lapping tools.

A plasma-processed lapping tool fabricated in this manner was mounted to a lapping apparatus and lapping tests were made on a magnetic head air bearing surface. In a specific lapping method, a magnetic head making a sample for lapping was held on a jig with a polyurethane elastic body therebetween and pushed against respective lapping tools at a predetermined load (load range: 20 to 100 g) to be worked. A minimum worked amount was made about 30 nm and hydrocarbon oil was used as a lubricant (finish liquid) used at the time of lapping.

In order to evaluate a performance improvement in a lapping tool, which was achieved by introduction of plasma process, evaluation of a gripping capability (grain drop rate) for abrasive grains embedded into a surface plate surface and of surface roughness (surface roughness) of a magnetic head air bearing surface as worked, and transition of lapping efficiency (tool life) were made.

Figure 7:
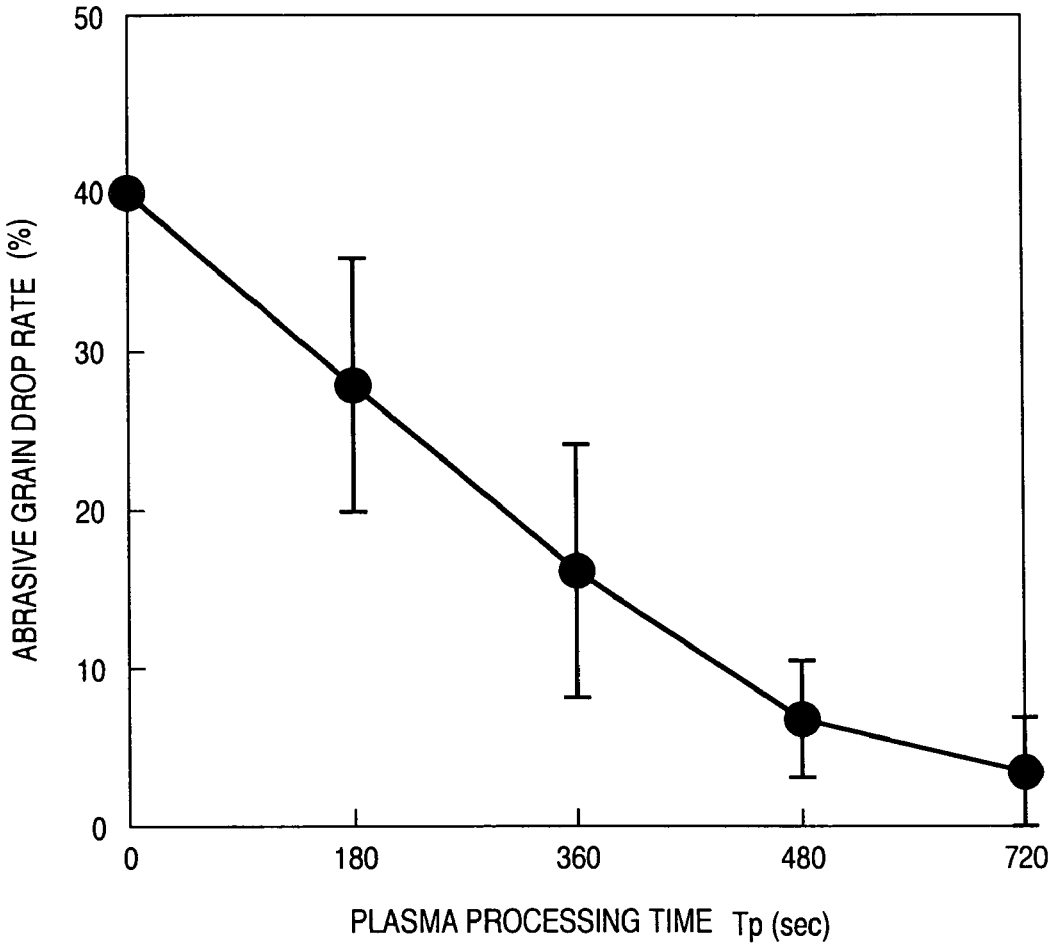
FIG. 7 is a correlation diagram illustrating the relationship between plasma processing time Tp and grain drop rate.

FIG. 7 shows results of an examination related to grain drop rate of a lapping tool in the case where diamond abrasive grains having an average size of about 80 nm were subjected to mechanically embedding process described above and plasma process, which is characteristic of the invention, and plasma processing time (Tp) therefor was changed. With respect to the grain drop rate, an electron microscopy was used to observe abrasive grains, which were embedded into a surface of a plasma-processed lapping tool, before and after a lapping test, in which respective magnetic heads were successively worked and an integrating time, during which the tool was used, was about 100 minutes. An electron microscopy S800 manufactured by Hitachi, Ltd. was used in observation and a magnifying power in measurement of a secondary electron image was 20,000 magnifications. Several locations on the tool were observed, and the number of ascertainable diamond abrasive grains was counted in the range of visibility and evaluated before and after lapping tests. Since evaluation in the same location was difficult, the grain drop rate was calculated with the use of an average value of the number of abrasive grains, for which several locations were measured before and after lapping.

Consequently, while the grain drop rate was about 30 to 50% in the case where no plasma processing was performed, a considerable decrease in drop abrasive grains was ascertained by perrforming a plasma processing. In particular, it could be ascertained that the grain drop rate amounted to about 0 to 7% in the case where the plasma processing with Tp=720 sec was applied. It is thought that the reason for this is that a plasma processing time is increased whereby an interface of an abrasive grain-tin surface is increased in chemical binding intensity. Also, it is possible to ascertain that dispersion in grain drop rate tends to decrease with an increase in plasma processing time.

Figure 8:
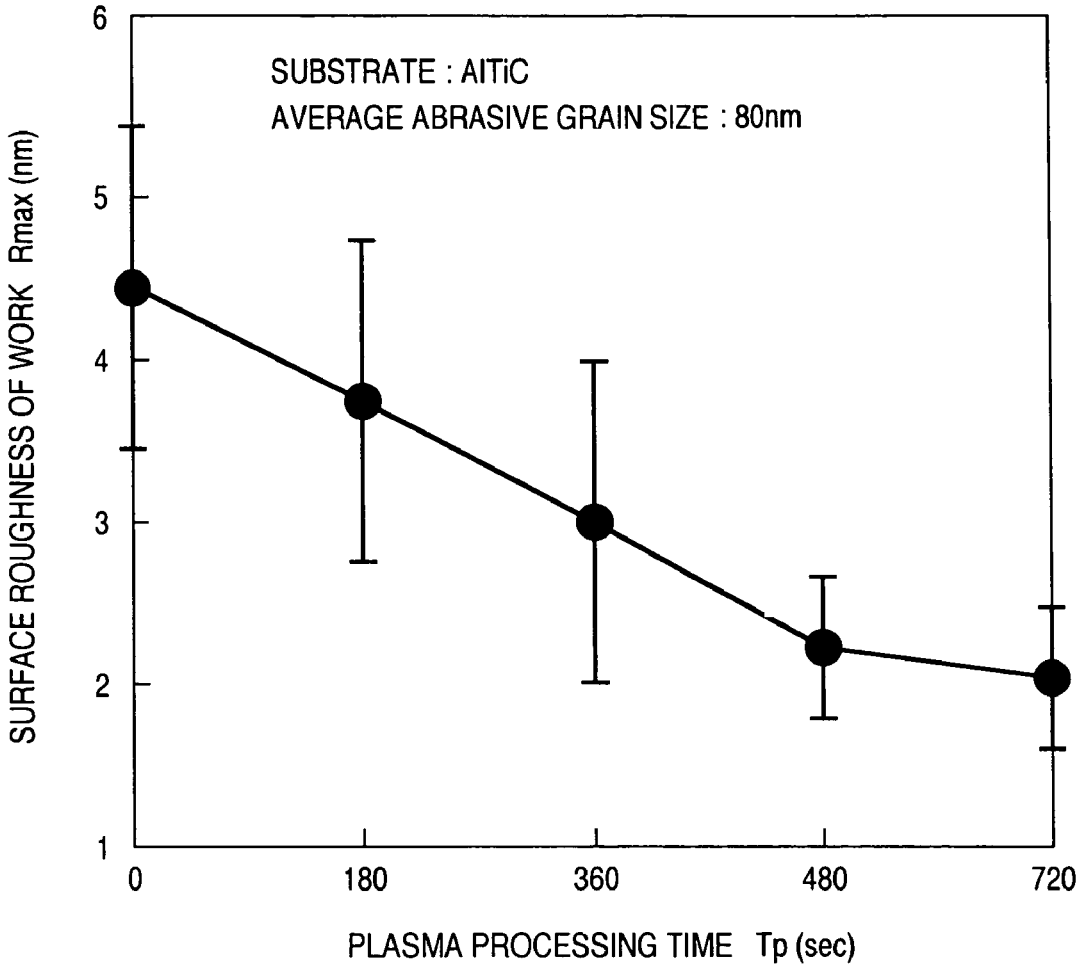
FIG. 8 is a correlation diagram illustrating the relationship between plasma processing time Tp and surface roughness of a work ($Al_2O_3$—TiC).

Subsequently, magnetic head air bearing surfaces as worked were evaluated with respect to surface roughness. An interatomic force microscope (AFM: Nanoscope IIIa, D3100) manufactured by Veeco Ltd. in the United States was used for measurement of surface roughness and a silicone single crystal probe having a tip end diameter of 10 nm was used. FIG. 8 shows results of observation of surface roughness of $Al_2O_3$—TiC being a product to be worked having been subjected to the same lapping processing with the use of a lapping tool after plasma processing, which was performed with a plasma processing time changed in the range of 0 sec, 180 sec, 360 sec, and 720 sec.

According to the results, the surface roughness decreases with an increase in plasma processing time (Tp). It is thought that the reason for this is that drop abrasive grains (loose abrasive grains) decreased, and an effect could be ascertained, in which dispersion in surface roughness decreased to ±0.5 nm in a range, in which a plasma processing time was 480 sec or longer.

Figure 9:
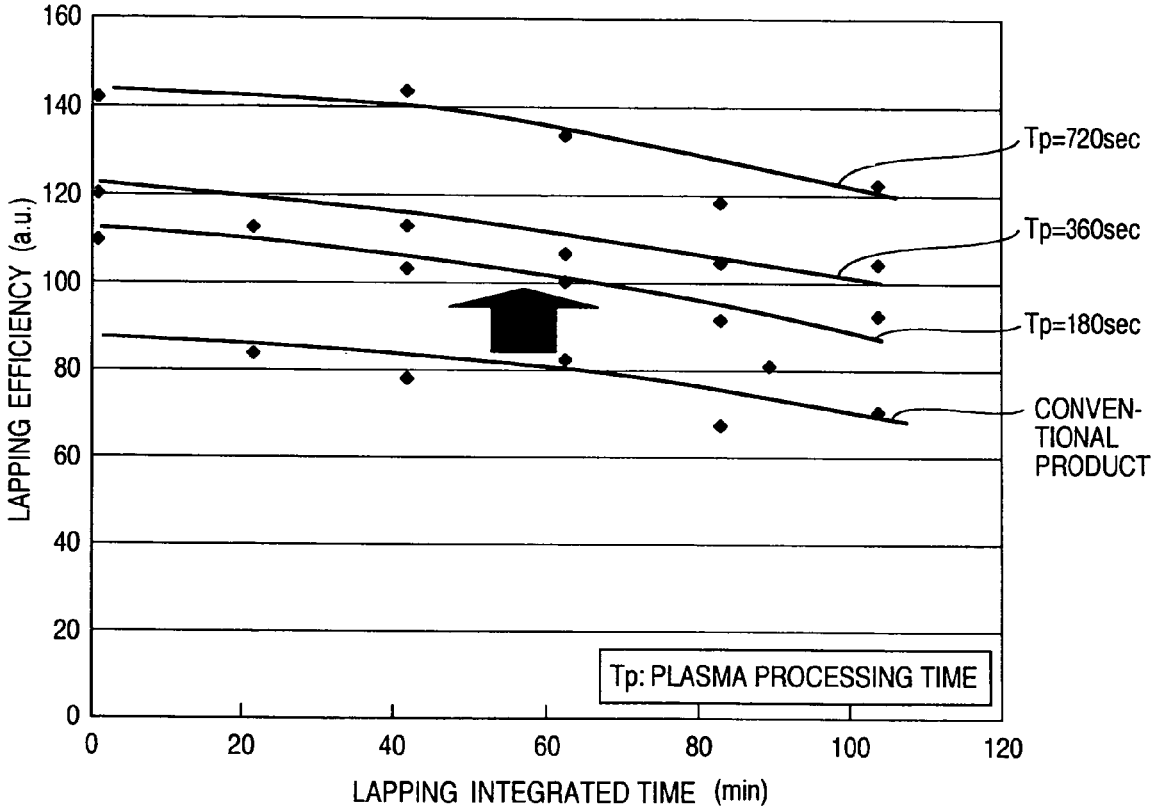
FIG. 9 is a correlation diagram illustrating the relationship between lapping integrated time and lapping efficiency.

Subsequently, FIG. 9 shows results of evaluation tests of transition of lapping efficiency (tool life). In the tests, magnetic heads were worked predetermined period of time by predetermined period of time and lapping efficiencies at that time were calculated. The respective magnetic heads were successively worked and a whole integrating time, during which the tool was used, was made about 100 minutes. In evaluating lapping efficiencies, a so-called magnetic property evaluation equipment (a four-terminal quasi tester manufactured by Hitachi Equipment, Ltd.), or the like was used to measure a value of resistance of an element part to find a worked amount of an element, which was used as a worked amount of a whole magnetic head. Thereby, a worked amount per unit time was defined as lapping efficiency.

FIG. 9 shows results of tests conducted on lapping time and lapping efficiency. According to the results, it can be ascertained that the lapping efficiency increases with an increase in plasma processing time (Tp), during which a plasma-processed lapping tool according to the invention was processed. In particular, it could be ascertained that a plasma-processed lapping tool processed during the plasma processing time Tp=720 sec was about 1.5 times or more in lapping efficiency than conventional products.

Figure 10:
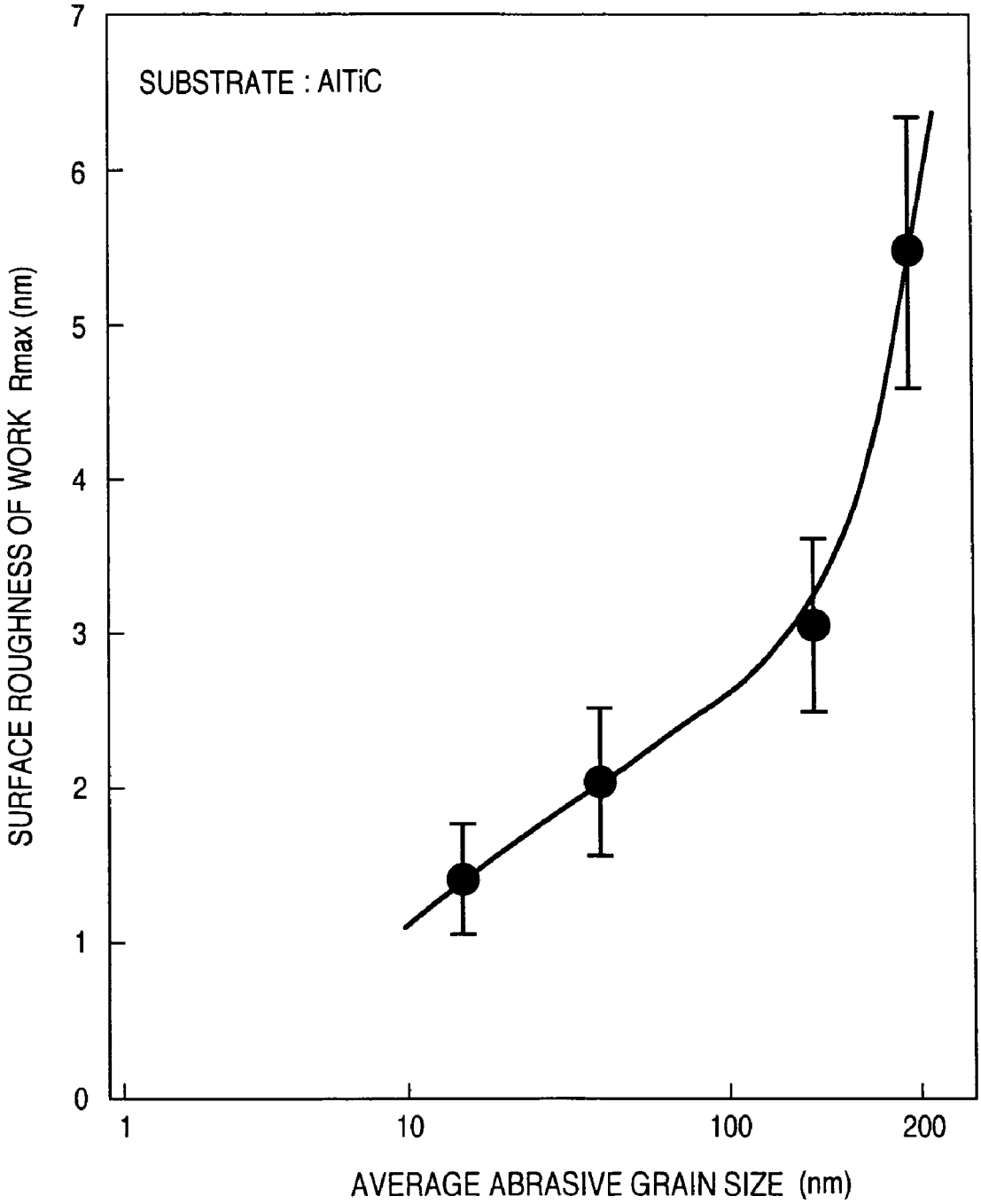
FIG. 10 is a correlation diagram illustrating the relationship between an abrasive grain average size and surface roughness of a work ($Al_2O_3$—TiC)

FIG. 10 shows results of measurement of Rmax of a substrate surface by AFM in the case where $Al_2O_3$—TiC being a substrate of magnetic heads was subjected to lapping with the use of a lapping tool, for which the plasma processing time was Tp=720 sec. The tests presented data in the case where diamond abrasive grains being embedded were changed in size. According to the results, it could be ascertained that the surface roughness after lapping decreased considerably with a decrease in size of diamond abrasive grains. This means that plasma processing is effective even when diamond abrasive grains are decreased in size, with the result that a decrease in drop abrasive grains is substantiated.

Figure 11:
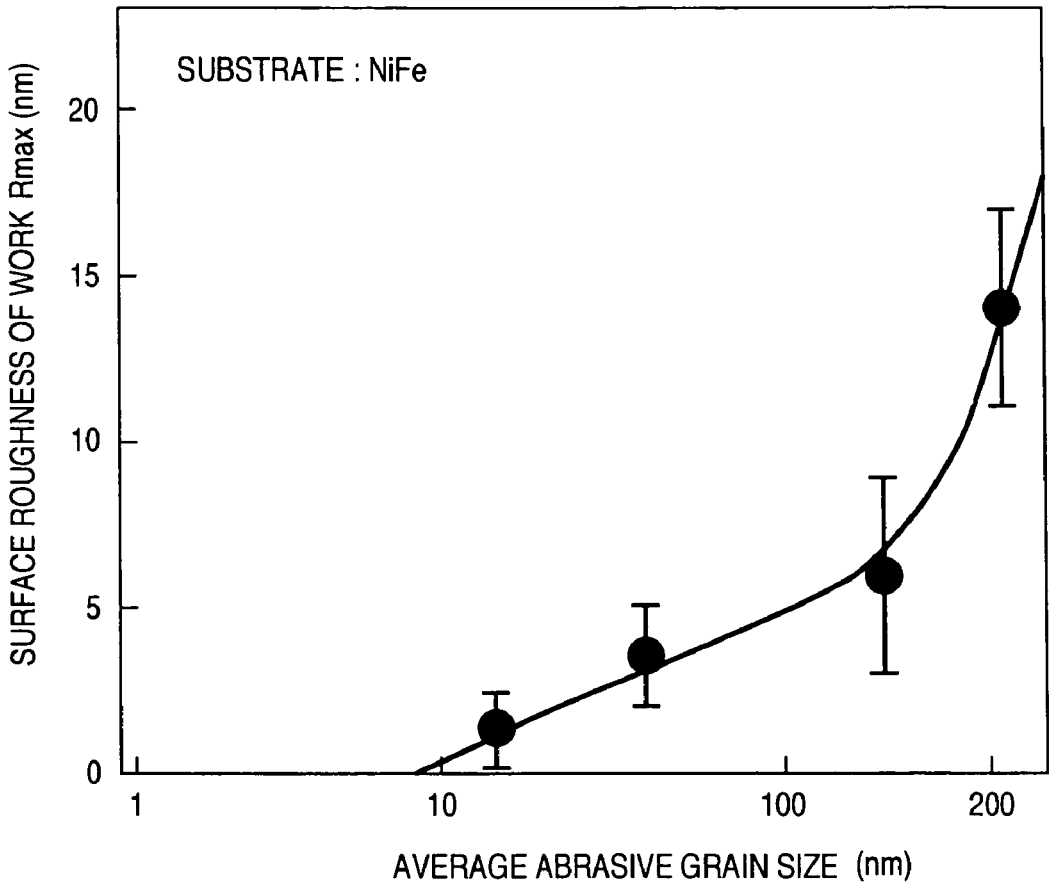
FIG. 11 is a correlation diagram illustrating the relationship between an average abrasive grain size and surface roughness of a work (NiFe).

FIG. 11 shows results of measurement of a NiFe film being a member of a magnetic head with respect to surface roughness in the same manner as described above, and it could be likewise ascertained that the surface roughness after lapping decreased considerably with a decrease in size of diamond abrasive grains.

As described above, it could be ascertained that a lapping tool having been subjected to plasma processing was improved both in lapping efficiency and abrasive grain gripping capability and the lapping accuracy was improved both in average value and dispersion as compared with conventional lapping tools.

Figure 12:
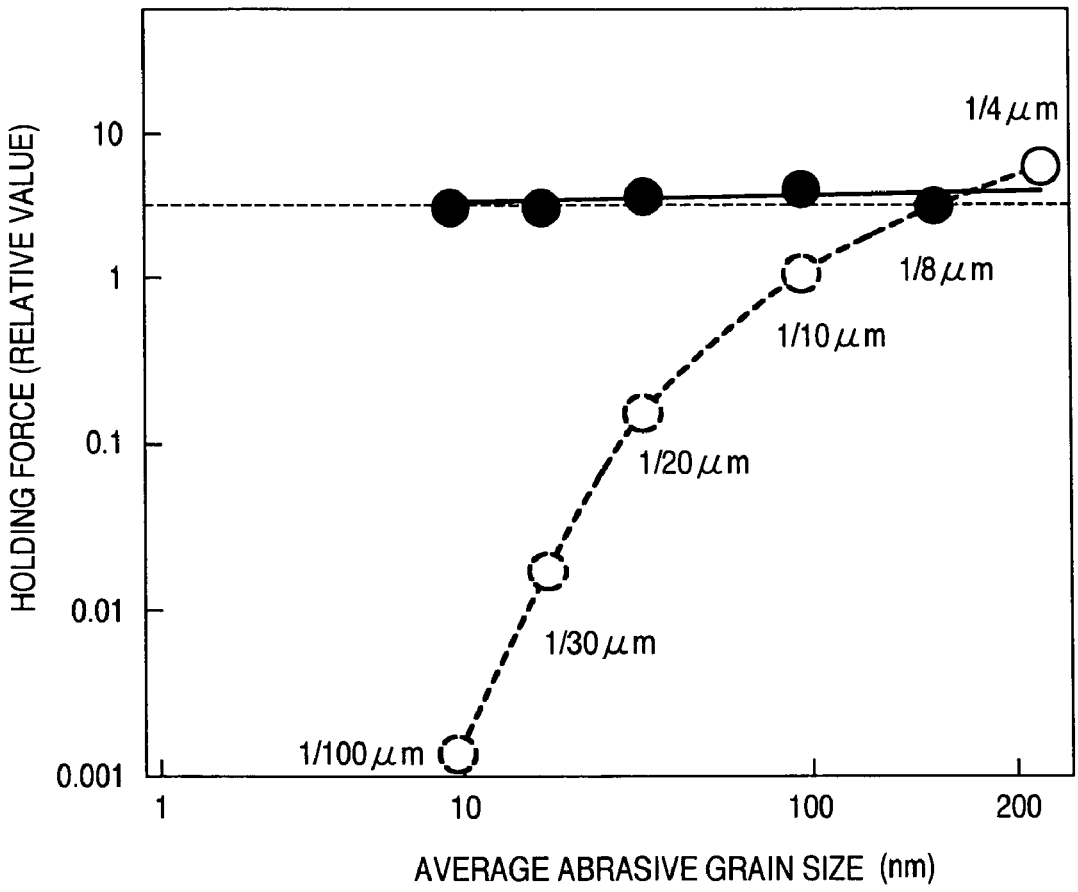
FIG. 12 is a view illustrating the relationship between an abrasive grain size and an abrasive grain gripping force in a lapping tool according to the invention, to which plasma processing is applied.

Finally, FIG. 12 shows a diamond abrasive grain gripping force 121 in a lapping tool having been subjected to plasma processing, according to the invention, with a gripping force for abrasive grains having a size of 100 nm in conventional lapping tools as reference value. As seen from the drawing, it is possible to obtain results of apparent predominance, in which a decrease in gripping force, accompanying a decrease in size of abrasive grains can be prevented, so that a lapping method directed to a decrease in surface roughness generated in a lapping site and small damage due to working can be provided in manufacture of general electronic or optical devices including magnetic heads and optical connector ferrules, which are made of a composite material.

Figure 13:
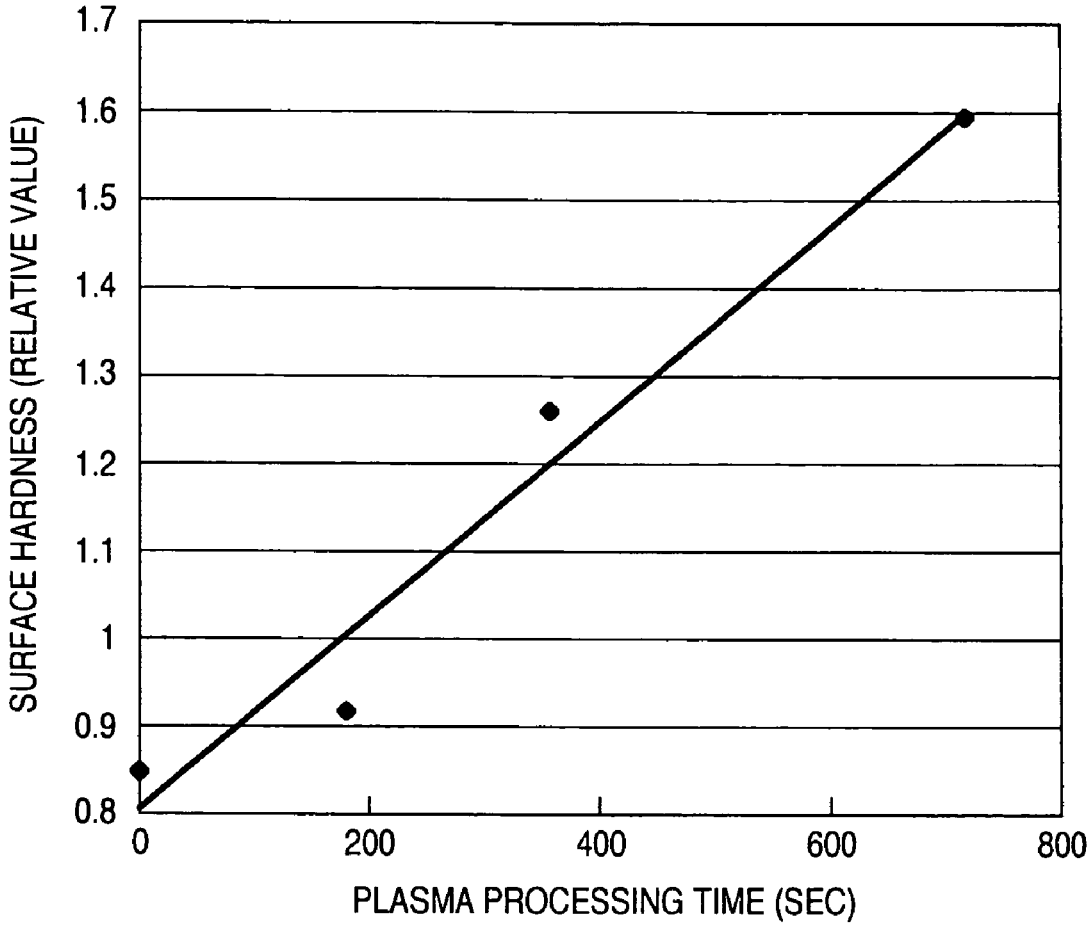
FIG. 13 is a view illustrating the relationship between plasma processing time and surface hardness in a lapping tool according to the invention.

As a factor for an improvement in gripping force, there is thought an improvement in surface hardness of a base material of the plate, which is achieved by plasma processing, shown in FIG. 13. A surface plate, into which no abrasive grains were embedded, was subjected to plasma irradiation and an uppermost surface thereof after irradiation was measured with respect to hardness by means of a nano-indentation tester to provide the results, and it was found that the hardness increased with an increase in plasma irradiation time. It is thought that the reason for this is that striking of argon ions onto the uppermost surface of the base material of the plate results in an increase in lattice strain with increase in number of striking of argon ions.

Figure 14:
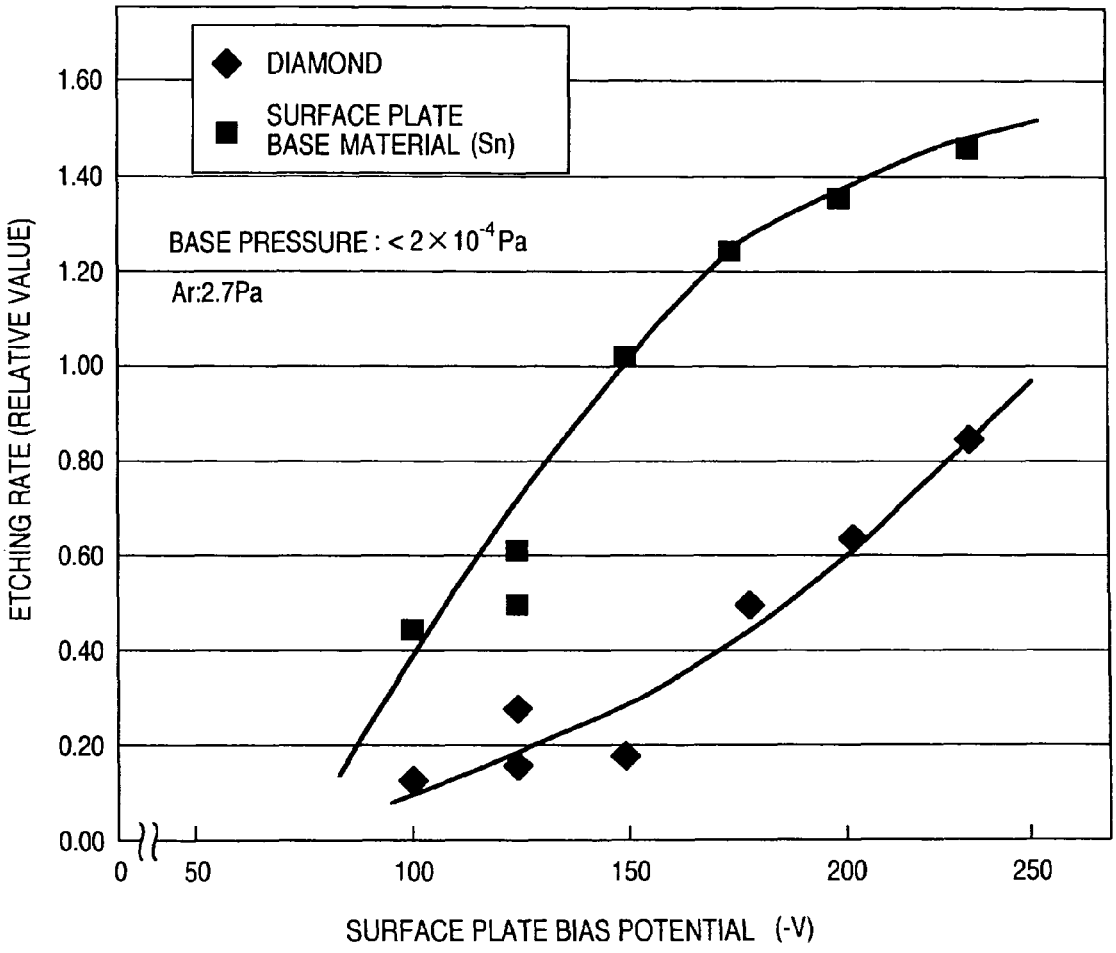
FIG. 14 is a view illustrating the relationship between diamond abrasive grains on a lapping tool and an etching rate of a base material of the plate in plasma radiation.
Figure 15:
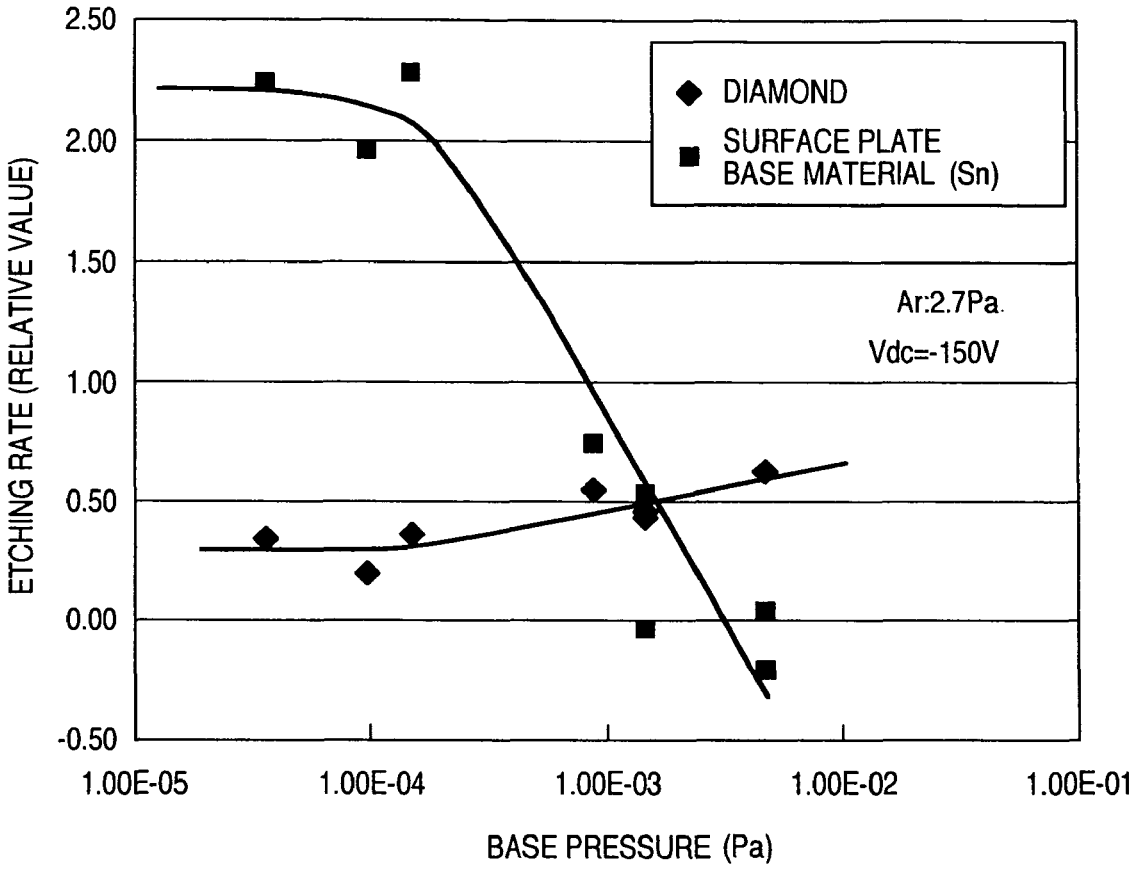
FIG. 15 is a view illustrating the relationship between diamond abrasive grains on a lapping tool and a processing base pressure in etching rate of a base material of the plate in plasma radiation.

FIG. 14 shows etching rates of diamond being a component of abrasive grains and a tin alloy being a base material of the plate with plasma irradiation. Thus a tin alloy is larger about 2.5 times a difference in etching rate between the both than the other in the range of −100 V to −200 V, and plasma irradiation under such condition makes it possible to increase an amount, by which diamond abrasive grains project from a surface of a surface plate, in accordance with a processing time. However, the results are obtained from measurement under the condition of a base pressure of $2\times10^{-4}$ Pa or less but a tin alloy is rapidly lowered in etching rate under the condition of a bad base pressure, in particular, $5\times10^{-4}$ Pa or higher, and diamond abrasive grains are increased in etched amount at $1.5\times10^{-3}$ Pa or higher. This is because tin surfaces oxidize and tin oxide is low in etching yield, while diamond is increased in etching rate due to oxidation. In order to perform the processing, it is necessary to make a base pressure equal to or less than $5\times10^{-4}$ Pa to avoid influences of oxidation.

Figure 16:
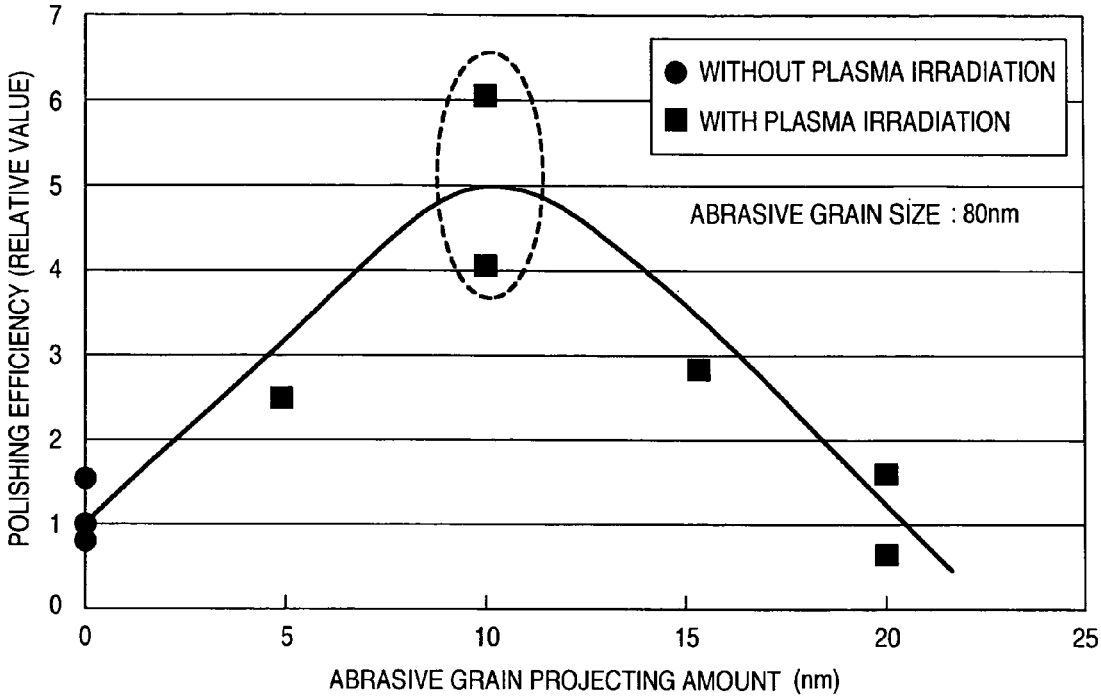
FIG. 16 is a view illustrating the relationship between an amount, by which abrasive grains project from a lapping tool in plasma processing, and lapping efficiency.

In FIG. 16, the relationship between an amount, by which abrasive grains projected, and a lapping efficiency of a surface plate is evaluated when a surface plate, into which abrasive grains having an average size of 80 nm were embedded, was subjected to Ar plasma irradiation processing at a bias potential of the surface plate of −125 V and time was controlled to increase an amount, by which abrasive grains projected. By increasing projection of abrasive grains with plasma irradiation, an increase in lapping efficiency can be achieved to realize an increase of about 5 times in efficiency owing to an increase of 10 nm in projected amount. An optimum value of a projected amount is thought to depend upon sizes of abrasive grains and an excessive projected amount is not effective by virtue of abrasive grains being liable to fall, so that around 10 nm was optimum in the embodiment.

Figure 17:
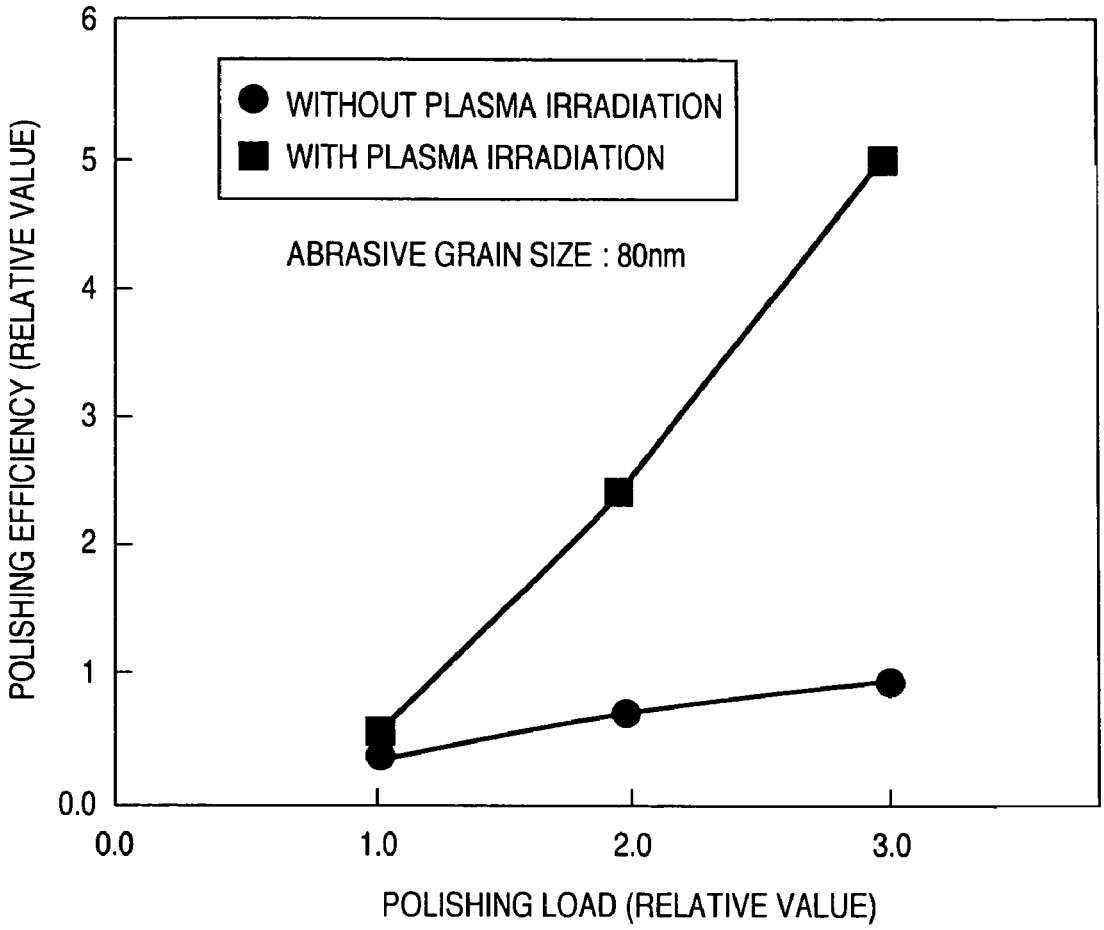
FIG. 17 is a view illustrating the relationship between a lapping load and lapping efficiency.

FIG. 17 shows the relationship between a lapping load and a lapping efficiency. As compared with the case where a surface plate having been subjected to plasma irradiation processing is greatly improved 8 times or more at maximum in lapping efficiency by increasing a load (surface pressure on a surface plate contact surface) on a product to be worked during lapping, an ordinary surface plate having not been subjected to plasma processing is improved at most around 2 times in lapping efficiency. Such difference in the effects is thought to be attributable to a difference in number of those abrasive grains, which act on products to be processed.

Amounts, by which individual abrasive grains embedded into a surface plate as a model project from a surface plate surface, involve dispersion, and abrasive grains brought into contact with a surface of a worked product to contribute to a lapping action are only ones having large projected amounts in the case where a lapping load is small, and so the lapping efficiency is low. Abrasive grains being large in projected amount are depressed down by an increase in lapping load and a worked surface of a product to be worked approaches to a surface of a surface plate and comes into contact with abrasive grains of small projected amounts whereby abrasive grains contributing to lapping are increased to lead to an improvement in lapping efficiency.

With an ordinary surface plate having not been subjected to etching processing with plasma, whole abrasive grains were small in average projected amount and promptly approached a base material of the plate in case of an increase in load, and so an increase in number of abrasive grains could not be attained. Abrasive grains are appropriately increased in projected amount by etching a surface of a base material of the plate with plasma processing according to the invention whereby abrasive grains having been embedded deep and having not been heretofore used for lapping can also be made use of, thus enabling an improvement in lapping efficiency.

An improvement in lapping efficiency on the basis of the present principle depends not only upon a dry etching method with Ar plasma processing illustrated in the embodiment but also dry etching with other Inert gases than Ar is effective. Further, it is possible in principle to make use of a wet etching method with acid or alkali solution and a method with mechanical treatment as a method of increasing amounts, by which abrasive grains project.

However, a method with plasma processing according to the invention can provide a lapping tool of high quality, which produces an effect of decreasing drop of abrasive grains owing to plasma irradiation, and in which drop of abrasive grains is not generated even when abrasive grains are increased in projected amount. Further, as compared with other methods, use of a plasma processing method gives uniformity and reproducibility to be applicable to industrial use.

The invention can provide a lapping method directed to a decrease in surface roughness generated in a lapped site and small damage due to working in manufacture of general electronic or optical devices including magnetic heads and optical connector ferrules, which are made of a composite material.

While we have shown and described several embodiments in accordance with our invention, it should be understood that disclosed embodiments are susceptible of changes and modifications without departing from the scope of the invention. Therefore, we do not intend to be bound by the details shown and described herein but intend to cover all such changes and modifications, which fall within the ambit of the appended claims.

The invention claimed is:

1. A method of manufacturing a lapping tool used for lapping a substrate surface, the method comprising:

forcing abrasive grains into a surface of the lapping tool with mechanical pressure to embed fixed abrasive grains into a base material of the lapping tool, the fixed abrasive grains having a height of cutting edges being projecting from a surface of the base material equal to or less than 40% of a size of the fixed abrasive grains;

arranging the lapping tool in a vacuum chamber vessel; and then applying plasma processing to the surface of the lapping tool arranged in the vacuum chamber vessel, so as to increase a gripping force of an interface between the abrasive grains and the base material of the lapping tool wherein the abrasive grains embedded into the surface of the lapping tool comprise diamond fine grains having an average size of 10 to 100 nm.

2. A method according to claim 1, wherein the abrasive grains embedded into the surface of the lapping tool has an area density of 10 to 100 grains/$\mu m^2$ and points of action or surfaces of action, at which projections of the abrasive grains projecting from the surface of the lapping tool act as cutting edges, have heights in substantially the same plane, the heights being 4 to 40 nm from the surface of the lapping tool.

3. A method according to claim 1, further comprising the steps of:

introducing gases into the vacuum chamber vessel;

applying an electric current or an electric voltage between the lapping tool, which is arranged in the vacuum chamber vessel, and the vacuum chamber vessel to generate plasma on the surface of the lapping tool; and transporting ions in the plasma to the surface of the lapping tool to perform plasma processing.

4. A method according to claim 1, further comprising the steps of:

introducing Argon gases into the vacuum chamber vessel to generate plasma; and using a bias potential of the surface of the lapping tool, which is generated on the surface of the lapping tool, to transport Argon ions in the plasma to the surface of the lapping tool to perform plasma processing to the surface of the lapping tool.

5. A method according to claim 1, further comprising the steps of:

introducing Argon gases into the vacuum chamber vessel to generate plasma;

regulating a bias potential of the surface of the lapping tool, which is generated on the surface of the lapping tool, to a value in the range of −700 to 0 V; and then transporting Argon ions in the plasma to the surface of the lapping tool to perform plasma processing to the surface of the lapping tool.

6. A method according to claim 1, wherein Argon ions in the plasma, which are transported to the surface of the lapping tool, selectively etch a base material of the lapping tool in comparison with the abrasive grains forced into the lapping tool to control amounts by which the abrasive grains project from the surface of the lapping tool in the range of 5 to 30% of abrasive grain size.

* * * * *